US006244462B1

(12) United States Patent
Ehrensvard et al.

(10) Patent No.: US 6,244,462 B1
(45) Date of Patent: Jun. 12, 2001

(54) MEDICAMENT DISPENSE SENSING DEVICE

(75) Inventors: Jakob Ehrensvard; Stina Grip, both of Taby (SE)

(73) Assignee: CyPak AB, Taby (SE)

( * ) Notice: Subject to any disclaimer, the term of this patent is extended or adjusted under 35 U.S.C. 154(b) by 0 days.

(21) Appl. No.: 09/367,640

(22) PCT Filed: Feb. 13, 1998

(86) PCT No.: PCT/SE98/00256

§ 371 Date: Nov. 2, 1999

§ 102(e) Date: Nov. 2, 1999

(87) PCT Pub. No.: WO98/36727

PCT Pub. Date: Aug. 27, 1998

(30) Foreign Application Priority Data

Feb. 19, 1997 (SE) ..... 9700582

(51) Int. Cl.[7] ..... G07F 11/00

(52) U.S. Cl. ..... 221/7; 221/25

(58) Field of Search ..... 221/2, 3, 4, 5, 221/7, 13, 15, 25, 26; 206/531, 534, 528; 368/10, 107, 109

(56) References Cited

U.S. PATENT DOCUMENTS 5,836,474 * 11/1998 Wessberg ..... 221/25

FOREIGN PATENT DOCUMENTS

| | | |
|---|---|---|
| 195 16 076 A1 | 11/1996 | (DE) . |
| 19516076 | 11/1996 | (DK) . |
| 9407184 | 3/1994 | (WO) . |
| WO 94/07184 | 3/1994 | (WO) . |

* cited by examiner

*Primary Examiner*—Kenneth W. Noland
(74) *Attorney, Agent, or Firm*—Pillsbury Winthrop LLP

(57) ABSTRACT

A device to register the dispensing of medicaments comprising sensing devices located at the medicament side to detect the dispensing thereof. The device is comprised of a sheet-like envelope of a one-way material and being a continuous, foldable way adapted to enclose the medicaments. There is an electronic printed circuit applied on the envelope and is stretched over foldable areas of the sheet-like envelope. It is also operatively connected to the sensing devices and to an electronic unit.

14 Claims, 4 Drawing Sheets

MEDICAMENT DISPENSE SENSING DEVICE

This application is the national phase of international application PCT/SE98/00256 filed Feb. 13, 1999 which designated the U.S.

FIELD OF THE INVENTION

The present invention relates to a medicament dispense sensing device comprising sensing devices located at the medicament dispense side to detect said dispense, the sensing devices being electrically connectable to an electronic sensing unit.

BACKGROUND OF THE INVENTION

The sensing devices are usually more or less integrated in such known devices (see e.g. U.S. Pat No. 4,616,316) or steadily connected to a package, e.g. a blister package, for the medicament or contain a separate sensingunit possibly being arranged in a container for the package (see e.g. U.S. Pat. No. 5,412,372).

SUMMARY OF THE INVENTION

An object of the present invention is to provide a one-way device of the kind mentioned above at low production costs and easily adaptable to different kinds of medicament packages without interfering with them.

According to one embodiment of the invention the device comprises a sheetlike envelope of a one-way material arranged in a continuous doublefolding way to enclose the medicaments and an on the envelope printed electrical circuit stretching over the sheetlike envelopes foldable portions and positively connected to said sensing devices and connectable to the electronic unit.

The device incorporating a foldable sheetlike envelope it can be produced quickly and easily at a low cost in form of semifinished products using sheet processing machines with subsequent stations for e.g. printing, foiling, punching, folding and embossing, and is by means of low tool and resetting costs adapted to medicament and blister packages of various shapes, quantities and geometries and with different graphical information. The semifinished products can thereafter be filled by means of an automized packaging automatics with medicaments and with the electronic unit and sealed to a finished package. The sheet material consists preferably of board, plastics or a combination of these. Within the medical service and the medicament handling, moreover, high hygienic standards are required. With an envelope of a one-way material the patient will always be supplied with a new and hygienic package.

The device is not influencing the integrity of today's clinically approved blister packages and therefore not either the enclosed medicaments.

Other features and advantages of the invention are evident from the claims and the detailed description to follow.

BRIEF DESCRIPTION OF THE DRAWINGS

An execution example of the invention is described herein below with reference to the enclosed drawing, on which

DETAILED DESCRIPTION OF THE PREFERRED EMBODIMENTS

Figure 1:
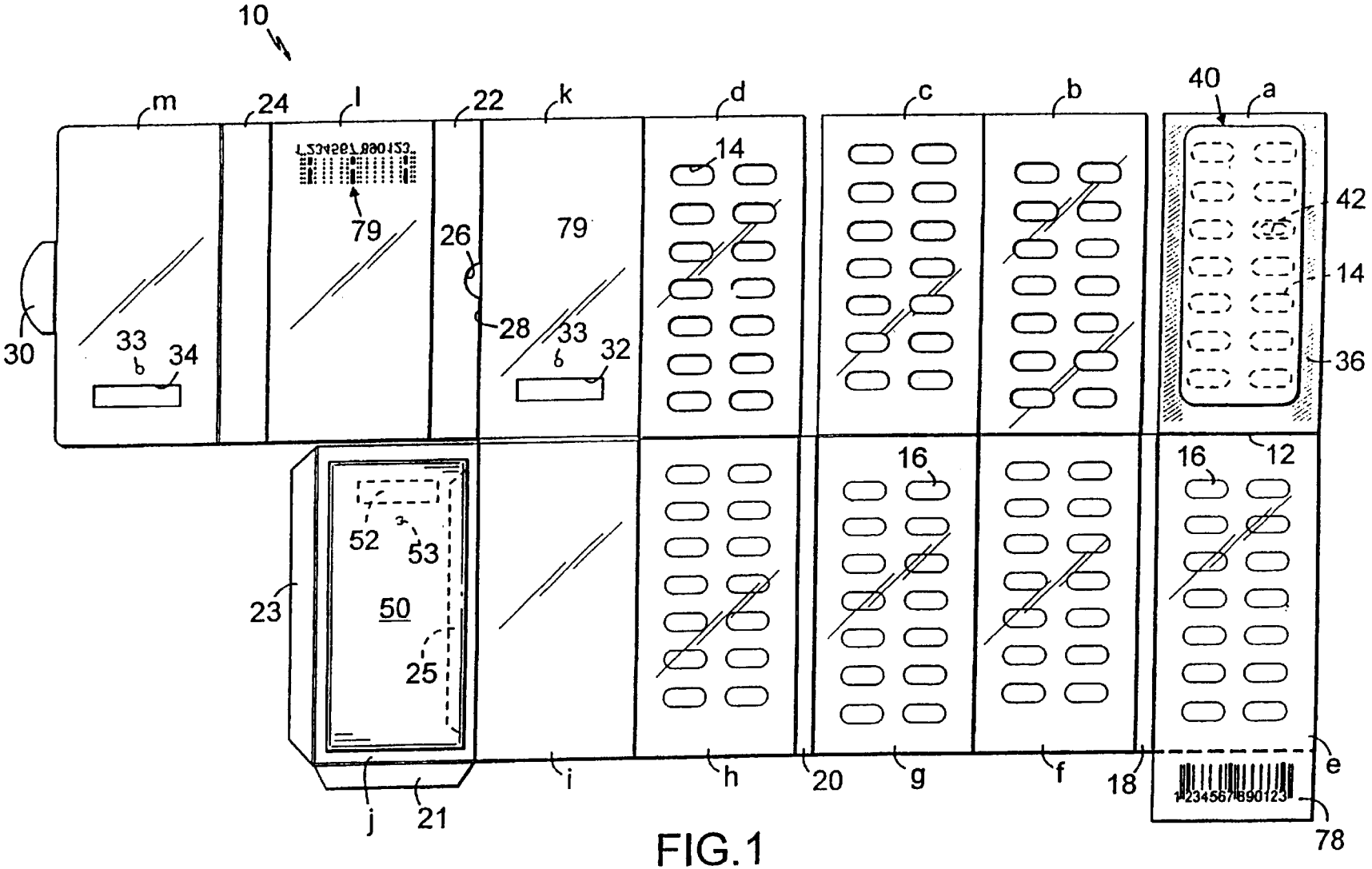
FIG. 1 shows a plane view of a spread sheetlike envelope for a device according to the invention.

In FIG. 1 a generally with 10 assignated sheetlike envelope is shown in a spread shape after a punching and folding operation.

In the execution example in FIG. I the envelope 10 is after the punching and folding operation devided into thirteen rectangular sheet fields a–m, being foldable along, folds or folding lines, shown with double lines such as 12 in FIG. 1 to enclose blister packages 30 in a folded shape after a packaging operation and an electronic unit 50 in form of a plane, parallelepipedic, compact package 38 (FIG. 2) like a diary or a planning calendar.

During the packaging operation first four blister packages, of which only one is shown, are placed in the sheet areas or flaps a-d with the blister packages 40 towards the areas e–h to surround the blister packages 40 so that each of the blister packages breakable dispense areas 42 for the medicaments corresponds to a matching breakable gate 16 in the areas e–h. Each breakable gate 16 is e.g. achieved by means of a partial punching of its profile. For keeping the flaps a–d together in the folded shape towards the corresponding sheet area e–h strings or ribbons 36 with adhering or glueing material are applied on the flaps a–d. The thus folded pairs of sheet areas ae, bf, eg and dh surrounding each its blister package 40 are thereafter folded in a zigzag pattern against each other (FIG. 2) along the corresponding vertical folds so that the blister packages 40 by means of the openings 14 exposed blisters are facing each other. The openings 14 and gates 16 corresponding to the blisters are vertically displaced with half a pitch between vertically adjacent sheet areas so that the blisters in one sheet area in a tightly packed way can be forced in between the blisters in the adjacent pair of sheet field during its folding. The thickness of two surrounded and folded blister packages thus corresponds essentially to the width of the ridges 18, 20 formed in the sheetlike envelope (FIG. 1) and are therefore not much larger than the thickness of a blister package 40.

The remaining part of the sheetlike envelope 10 comprises in the illustrated example the sheet areas i–m and a pair or ridged 22, 24. More precisely, the sheet areas i j k are adapted to surround a flat rectangular electronic unit 50, connected to the onto the sheetlike envelope printed circuit to be described further on. The electronic unit 50, arranged in the sheet area j in a way to be described later, is first folded together with the sheet area j towards the flap i. Then, flaps 21, 23 might be arranged in the sheet area j for by means of e.g. a here not shown string of a binder uniting the sheet area j and the sheet area i. For uniting the sheet areas in a safe way several, here not shown glue or binder strings corresponding to those shown in the sheet area a in FIG. 1 might be arranged. The binder may even consist of an outside laminate layer 90 (FIG. 6) on the sheetlike envelope 10, possibly locally heated and coalesced, e.g. by means of ultrasonic welding of the folded sheet areas. This laminate layer 90 is also preferably even electrically isolating to mechanically and electrically protect said printed circuit. A similar laminate layer is conveniently even arranged between the sheetlike envelope 10 and the printed circuit.

Figure 2:
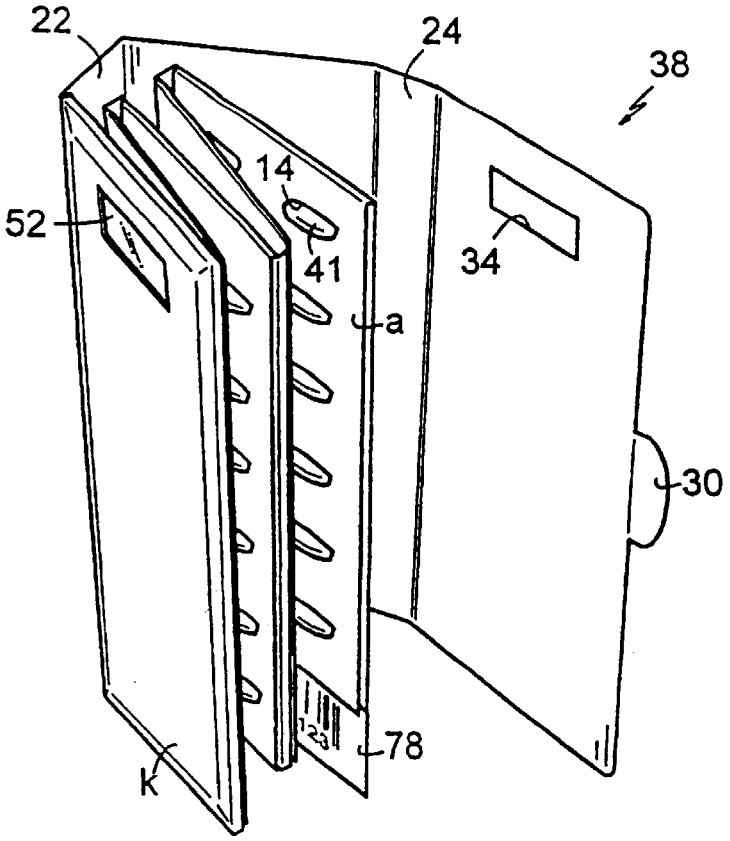
FIGS. 2 and 3 show in perspective views several devices according to the invention and in a partly and a fully folded shape, respectively.
Figure 3:
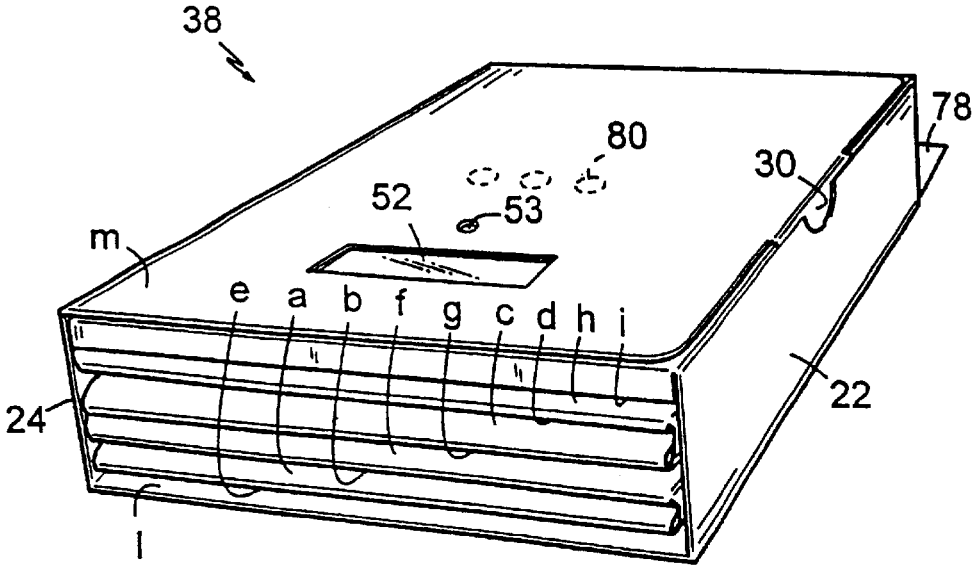

The sheet areas a–f might in the folded shape as above be arranged on top of each other at the sheet areas i point in the following order (see FIG. 3) from the top downwards: j i h d c g f b a e. In case the electronic unit 50 has a display 52, the sheet area k has a corresponding opening 32, coinciding with the display 52 in the sheet area k when the packaging operation is terminated in folding the sheet areas 1 and m and the ridges 22, 24 on top of the previously described arrangement to form the package 38 shown in FIG. 2. A locking flap 30 on the sheet area m units the package 38 being inserted in a slot 38 with an opening 26. Even the sheet area m has a display opening 34 so that the electronic units display 52 can be watched from the outside of the package 38 (FIG. 3).

Figure 4:
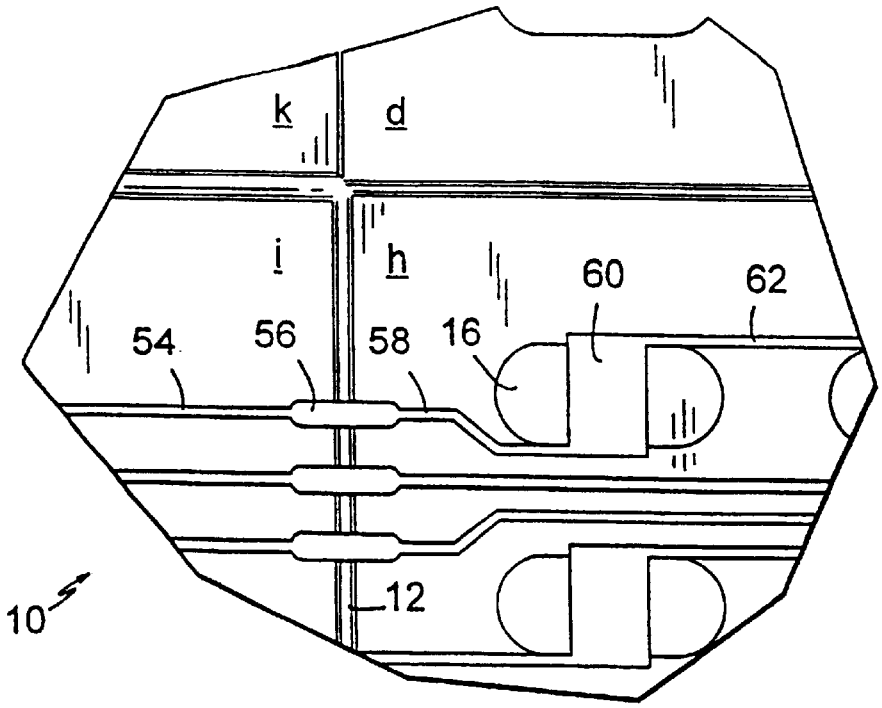
FIG. 4 shows in a larger scale a cut-off portion of a spread, sheetlike envelope according to FIG. 1 with a printed circuit.

A part of the above mentioned printed circuit is shown in FIG. 4. The printed circuit stretches via connected printed circuit portions 54, 56, 58, 60, 62 in form of here not shown closed loops from the conducting connection with the electronic unit 50 to each of the sheetlike envelopes 10 gates 16 and back to the conduction connection with the electronic unit 50. The printed circuit according to a preferred embodiment of the invention is provided by printing an electrically leading printing colour form of an electrically leading polymer material by means of conventional graphic printing methods, the colour especially conveniently been printed over the folds or folding lines 12 of a sheetlike envelope according to the present invention, as it due to its inherent toughness can resist a multiple folding without any risque for a wire break. The printed circuit portions 50 stretching over the folds 12 might, however, in accordance with FIG. 4, be printed with a broader width to almost exclusively avoid any risque for an unintended wire break. However, it is possible to provide the printed circuit in form of a printable electrically conducting, here not shown film.

The registration of a medicament dispensing is provided in that each conducting loop stretches over a removable gate 16 so that the gate 16 is torn off at least on one side, when e.g. a tablet is ejected from a corresponding blister, this being registered as known in the art in the electronic unit 50, e.g. indicating the time and the position of the envelope/blister package. When the medicaments are used up according to the prescription the package is returned, the electronic unit 50 is thereafter removed and the registered data thereon are read for an eventual further evaluation of them. The electronic unit 50 can according to FIG. 3 even be provided with a diode lamp 53, exposed to the environment by means of corresponding holes 33 in the sheet areas k and m. The diode lamp is intended to emit information bearing modulated light from the electronic unit 50 to a here not shown reading device. Thus, the electronic unit 50 must not be removed from the sheetlike envelope 10 to send information during a e.g. prevailing observation of a patient. The diode lamp 53 is adapted to be activated by means of a hidden switch 80 of a type to be described in detail later on. The electronic unit 50 might in a way known in the art even be provided with signalling devices to the environment, when e.g. the medicaments shall be dispensed from the device.

Figure 5:
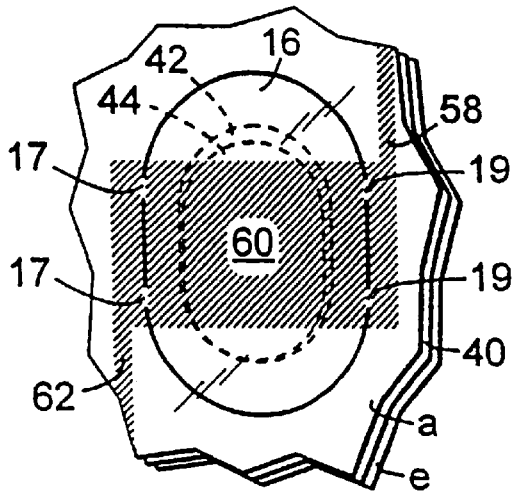
FIG. 5 shows an underside of a dispense area of a device according to the invention.

In FIG. 5 an example is shown more in detail of a configuration of the sheetlike envelope 10 at the portion of a dispense or exit area 42 for a tablet 44 of a blister package. Accordingly the breakable gates 16 periphery stretches outside of the blister packages 40 dispense area 42 for the tablet 44. The only partly stamped-out and cut-out gate 16 is connected with the sheetlike envelopes 10 corresponding sheet area, e.g. a, by means of two opposite non-perforated kerfs or land areas 17, 17 and 19, 19. In the unbroken shape these kerfs 17, 17 and 19, 18 achieve the electrical conductivity between the closed loops conductive portions 58, 60, 52. When the tablet 44 is to be dispensed from the blister package 40 in that the user presses on the blister 41 (FIG. 2) exposed through an opening 14 in the opposite sheet area e, a pressure is applied on the gate 16 so that at least one pair of kerfs 17, 17 or 19, 19 bursts and thus the conductivity between the conductive portions 58, 60, 52 is interrupted and the tablet can emerge through the opening provided by the opened or fully eliminated gate 16. The electric interruption is registered by the electronic unit 50 storing the place and time of the tablet dispense, basing on the information, which of the electric circuits closed loops has been interrupted.

Figure 6:
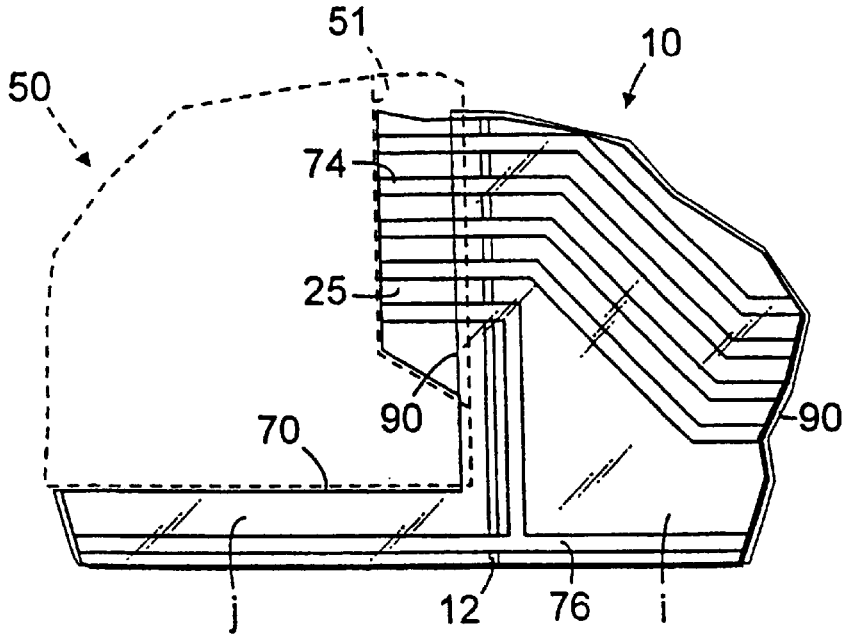
FIG. 6 shows a cut-off portion of the sheetlike envelope with a printed circuit at a connection point for the electronic unit and FIGS. 7A and 7B show in a cross section a portion of a device according to the invention supplied with a switch.

A portion of the sheetlike envelope is shown with reference to FIG. 6 at a connecting point for the electronic unit 50. The sheet area j in this execution example has an opening 70 with a profile with the exception of that a contact flap 25 essentially coincides with the electronic units 50 outside profile. The electronic unit 50 might in a preferred embodiment even be fixed by means of its here not shown resilient contact devices only on the contact flap 25 without the presence of the sheet area j and the flaps 21, 23. In this case cavities are embossed in the sheet areas i and k, as indicated in FIG. 2 for the sheet area k, to receive the width of the electronic unit 50. The flap 25 of the sheet area j forms a projecting male coupling device intended to be inserted into a corresponding slotlike female coupling device 51 in a longside edge of the electronic unit 50 so that the conducting ends of said closed loops and other conducting circuits might operatively be connected to the electronic unit 50 in such a way as it is illustrated in FIG. 6. According to FIG. 6 the previously described isolating laminate layer 90 is not protruding over the contact flap 25 to enable an electrical contact between the conducting ends 74 and the electronic unit 50.

In addition to the electrical interruption signals already described in connection with the dispense of a tablet 44 the electronic unit 50 might also register other signals, such as signals indicating the unbroken integrity of the package, the delivering of the package to a patient, resetting of a clock in the package for a new time zone, etc.

The conductor, such as the conductor 76 in FIG. 6, might therefore be a reference conductor for detecting any bursting of the envelope in some not expected way and also provide a calibration information for the electronic unit 50. The conductor 76 stretches in the shown example like a frame around at least some portions of the boxshaped envelope 10. Several such reference conductors might extend around the sheetlike envelope 10.

A flap 78 is shown in FIG. 1, provided with e.g. a package identity number in form of a bar code to be torn away when delivering the package and thus starting a here not shown conductor break to register the dispense and its time in the electronic unit 50 by sending a start signal to it. As can be seen at 79 in FIG. 1 the identity number is printed on a further spot of the package for an identity control in connection with the consumed package is returned and the electronic unit 50 is removed from the sheetlike envelope 10 for e.g. a following systemic evaluation of the patients data. The package identity must thus not be registered in the electronic unit 50 which in this easier way might be reused in a new package.

Figure 7A:
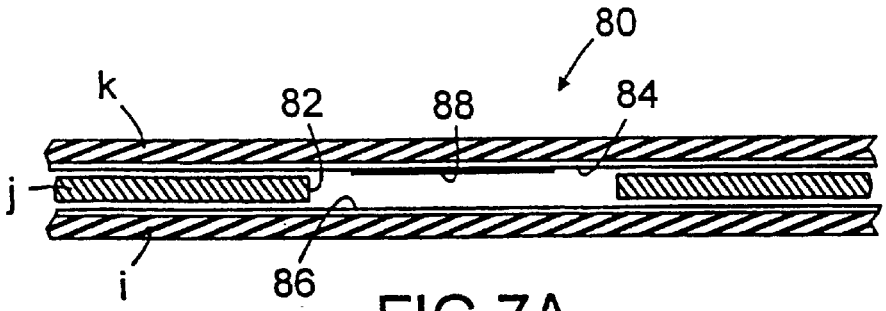
Figure 7B:
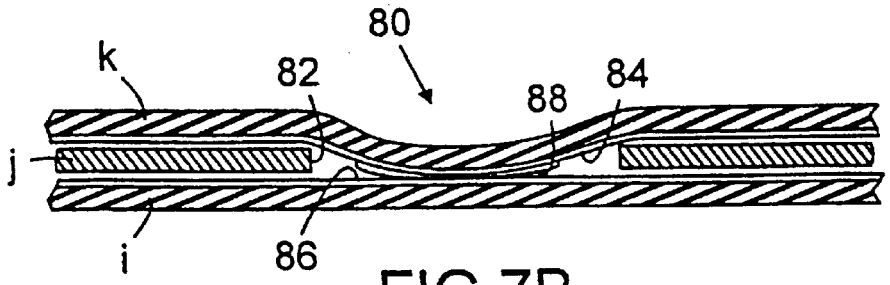

Finally, in FIGS. 7A and 7B an example is shown of an in the envelope integrated switch 80. The switch 80 is arranged in an area with three on top of each other placed sheet areas or flaps, e.g. somewhere in the three folded sheet areas i j k or by adding a here not shown sheet insert between a pair of sheet areas. The inserted sheet area j comprises an opening 82 permitting a manual depressing by means of a finger or a convenient device such as the blunt end of a pen of the upper sheet area k in contact with the lower sheet area i. The printed conducting portions 84 and 86 are thereby put into electrical contact with each other to close an electric circuit emitting a signal to the electronic unit 50. If an electrically conductive glue 88 is applied on at least one of the sheet areas conducting portions 84, 86 the contact can permanently maintain the closing of said electrical circuit. This switch arrangement can be used to activate different functions or to readjust various parameters of the electronic unit 50, e.g. the above mentioned activation of a diode lamp with information carrying modulated light or a stepwise change of a time zone setting of the electronic units clock.

What is claimed is:

1. A device for registering dispense of medicaments, comprising a plurality of sensing means (60) located at dispense areas (16) for the medicaments to detect said dispense, said sensing means being electrically connectable to an electronic unit (50) provided for said registering, comprising a sheet-like envelope (10) made of a disposable material, said envelope (10) being provided in a continuous, foldable manner to enclose said medicaments (44), and an electric circuit (54–62) which is printed onto the envelope (10), is stretching over foldable areas (12) of the envelope, is operatively connected to said sensing means (60) and is connectable to said electronic unit (50).

2. The device according to claim 1, wherein said medicaments are packed in so-called blister packages (40), on both sides enclosed by said envelope (10), and in that the envelope (10), at a side thereof, exposes blisters of the package (40) to enable the medicaments to be pushed out therefrom,.and at an opposite side thereof, is provided with said dispense areas (16) in correspondence with the blisters.

3. The device according claim 1, wherein the envelope (10) is adapted to enclose also the electronic unit (50).

4. The device according to claim 1, wherein the envelope (10) is a cut and scored piece of paperboard and/or plastics material.

5. The device according to claim 1, wherein the envelope (10) comprises rectangular sheet areas (a–m) foldable into a parallelepipedic, flat package (38).

6. The device according to claim 1, wherein the envelope (10) comprises rectangular pairs (ae, bf, cg, dh) of sheet areas enclosing the medicaments (44) and connected to each other by said foldable areas (12, 18, 20).

7. The device according to claim 1, wherein the electric circuit (54–62) forms said sensor means (60) by being electrically breakable at the respective dispense areas (16).

8. The device according to claim 1, wherein each dispense area comprises a flap (16) which is incompletely cut-out from the envelope by rupture-indicating lands (17, 19), the electric circuit (58, 60, 62) stretching over said lands and being adapted to rupture and electrically break when said lands are broken on pushing out the respective medicaments (44).

9. The device according to claim 8, wherein the electric circuit (58, 60, 62), in order to be broken, is adapted to rupture on at least two lands (17, 17; 19; 19) of the respective flap (16).

10. The device according to claim 8, wherein the electric circuit (58, 60, 62) stretches over at least a pair of lands (17, 17; 19, 19) at each side of a pair of opposite sides of the flap (16).

11. The device according to claim 1, wherein the printed electric circuit (54–62) comprises an electrically conducting polymer material.

12. The device according to claim 11, wherein the polymer material comprises an ink printable on the envelope (10) by means of a graphical printing method.

13. The device according to claim 1, comprising an electrically isolating layer (90) disposed on the envelope (10) on top of the electric circuit.

14. The device according claim 13, wherein the electrically isolating layer (90) comprises a locally meltable plastics material adapted to connect together folded sheet areas (a–k) of the envelope (10) by fusion.

* * * * *